US008852058B1

(12) United States Patent
Hamberis et al.

(10) Patent No.: US 8,852,058 B1
(45) Date of Patent: Oct. 7, 2014

(54) INTERACTIVE FINGER LADDER

(75) Inventors: Paul J. Hamberis, Greenville, SC (US); Jere A. Johnson, Greenville, SC (US)

(73) Assignee: Paul J. Hamberis, Greenville, SC (US)

( * ) Notice: Subject to any disclaimer, the term of this patent is extended or adjusted under 35 U.S.C. 154(b) by 522 days.

(21) Appl. No.: 13/182,476

(22) Filed: Jul. 14, 2011

(51) Int. Cl.

| | |
|---|---|
| ***A63B 71/00*** | (2006.01) |
| ***A63B 23/16*** | (2006.01) |
| ***A63B 23/00*** | (2006.01) |
| ***A63F 9/24*** | (2006.01) |

(52) U.S. Cl.
USPC ..... 482/44; 482/1; 482/8; 482/47; 482/902; 463/37

(58) Field of Classification Search
CPC .. A63B 23/16; A63B 2220/801; A63F 13/00; A63F 2300/1075; A63F 13/12; A61H 1/0288; A61H 2205/067; A61B 5/225; A61B 5/6826; E06C 7/003; G06F 2203/014; G06F 2203/013; G06F 3/0412; G06F 3/0414; G06F 3/0487; G09B 5/00; G09B 19/025
USPC ..... 482/1, 8, 23, 37, 44–50, 52, 91–92, 482/131, 139, 148, 901, 902, 907; D21/336, 337, 662, 684; 182/18; 272/447–448, 452; 434/258, 335, 339, 434/344, 346, 347, 355; 446/175, 318, 408, 446/418, 477, 484; 463/37; 472/48; 984/115; 84/464 R, 464 A, 465, 467, 84/470 R, 471 R, 472, 477 R, 478, 485 R
See application file for complete search history.

(56) References Cited

U.S. PATENT DOCUMENTS

| | | | | | |
|---|---|---|---|---|---|
| 2,692,526 | A * | 10/1954 | Watson | 52/182 |
| 2,823,918 | A * | 2/1958 | Lewis | 482/148 |
| 3,298,012 | A * | 1/1967 | Weller | 182/18 |
| 3,477,332 | A * | 11/1969 | Kreiss | 84/403 |
| 3,512,445 | A * | 5/1970 | Aaron | 84/471 R |
| 3,636,576 | A * | 1/1972 | Nissen | 5/420 |
| 3,749,810 | A * | 7/1973 | Dow | 84/701 |
| 3,775,546 | A * | 11/1973 | Honegger | 84/721 |
| 4,200,023 | A * | 4/1980 | Kaman | 84/293 |
| 4,669,353 | A * | 6/1987 | Kvistad | 84/403 |
| 4,848,737 | A * | 7/1989 | Ehrenfield | 482/52 |
| D313,424 | S * | 1/1991 | High | D17/99 |
| 6,578,663 | B2 * | 6/2003 | Schmitt et al. | 182/18 |
| 7,037,244 | B2 * | 5/2006 | Svihra et al. | 482/93 |
| 7,070,541 | B2 * | 7/2006 | Madigan et al. | 482/35 |
| 7,258,653 | B2 * | 8/2007 | Brandon et al. | 482/142 |
| 7,645,211 | B1 * | 1/2010 | Thomeczek et al. | 482/1 |
| 7,938,751 | B2 * | 5/2011 | Nicolas et al. | 482/1 |
| 2004/0009845 | A1 * | 1/2004 | Johnson | 482/41 |
| 2005/0233879 | A1 * | 10/2005 | Harrington | 482/148 |

(Continued)

*Primary Examiner* — Stephen Crow
*Assistant Examiner* — Joshua Lee
(74) *Attorney, Agent, or Firm* — Charlotte C. Wilson

(57) ABSTRACT

An interactive device includes a housing and a finger ladder held within the housing and having a number of parallel rungs. Each rung includes at least one sensor. A display system, which may include panels attached to either side of the ladder, produce sounds and/or images when the rungs of the ladder are contacted sequentially. Alternately, the display system may be integral with the finger ladder. The sounds and/or images may produce a song or a familiar sequence, such as the alphabet. The sequential activation of the sensors results in the development of both gross and fine motor skills, for example, in children, persons with developmental differences, and persons needing physical or occupational therapy.

18 Claims, 4 Drawing Sheets

(56) References Cited

U.S. PATENT DOCUMENTS

2006/0229171 A1* 10/2006 Severino ..... 482/93
2006/0247100 A1* 11/2006 Harker ..... 482/23
2006/0258512 A1* 11/2006 Nicolas et al. ..... 482/52
2009/0139798 A1* 6/2009 Bernard ..... 182/18
2010/0016125 A1* 1/2010 Bellandi ..... 482/4
2010/0292050 A1* 11/2010 DiBenedetto et al. ..... 482/9
2012/0028762 A1* 2/2012 Oleson et al. ..... 482/9
2012/0329623 A1* 12/2012 Ramirez ..... 482/139

* cited by examiner

INTERACTIVE FINGER LADDER

TECHNICAL FIELD

The disclosure relates generally to a device for exercising the upper extremities, and, in particular, to a finger exercise device that promotes fine motor skills, gross motor skills, and cognitive development through visual or audio prompts associated with a user's interactions with the device.

BACKGROUND

Traditional "finger ladders" include a vertical supporting frame for mounting on a vertical surface or wall and a number of rungs mounted to, or integral with, the support frame. These finger ladders, which are often made of wood, are used typically for rehabilitation of injuries to the upper extremities or for improvement of motor skills of persons with developmental challenges. When a user manipulates his second and third fingers up and down the rungs of the ladder, he increases his range of shoulder motion and simultaneously improves his manual dexterity and mental processing.

Most finger ladders have a simple construction, and users thereof have no incentive to complete their repetitions. In one commercially available product, the rungs of the ladder have a U-shape, and a single rung is colored differently at certain intervals. For instance, each sixth rung is red while the surrounding rungs are black. While useful in helping a user monitor his progress up the ladder, such indicia hardly motivates the user to continue his efforts.

U.S. Pat. No. 7,037,244 to Svihra et al. describes a more complex therapeutic arm exercise device, in which a finger ladder for accomplishing finger exercises is positioned alongside a slidable weight that is mounted on an elongated track. A user grasps a handle on the weight and slides the weight along the track. Separately, the user may manipulate his fingers up the rungs of the finger ladder for fine motor exercise. The device includes an audio annunciator for the slidable weight portion, but provides no similar encouragement for users of the finger ladder.

What is needed in the art is an interactive finger ladder, in which visual or audio cues stimulate a user to complete a progressive cycle of exercises up and down the rungs of the ladder. What is further needed is an interactive finger ladder having an integrated video display surface for providing such cues. Finally, it would also be desirable to use the visual or audio cues to promote learning or to provide entertainment, such that a child would be further motivated to complete the progressive cycle of exercises.

SUMMARY

An interactive device for increasing the motor skills and cognitive development of a user is provided. The interactive device includes a housing and a finger ladder held within the housing and having a plurality of parallel rungs. Each of the rungs defines a step, and at least one sensor is associated with each step. A display system is integrated with a portion of the finger ladder and is operably connected to the sensors, such that sequential activation of the sensors results in at least one of an image and a sound being produced by the display system. The visual and/or audio signals motivate the user to continue his finger exercises. The interactive device is useful and entertaining for children, persons with development differences, and persons needing occupational or physical therapy.

BRIEF DESCRIPTION OF THE DRAWINGS

A full and complete description of the present storage system is provided herein with reference to the appended figures, in which.

DETAILED DESCRIPTION OF THE DRAWINGS

Reference is now made to the drawings for a description of various aspects of an interactive finger ladder presented herein.

Figure 1:
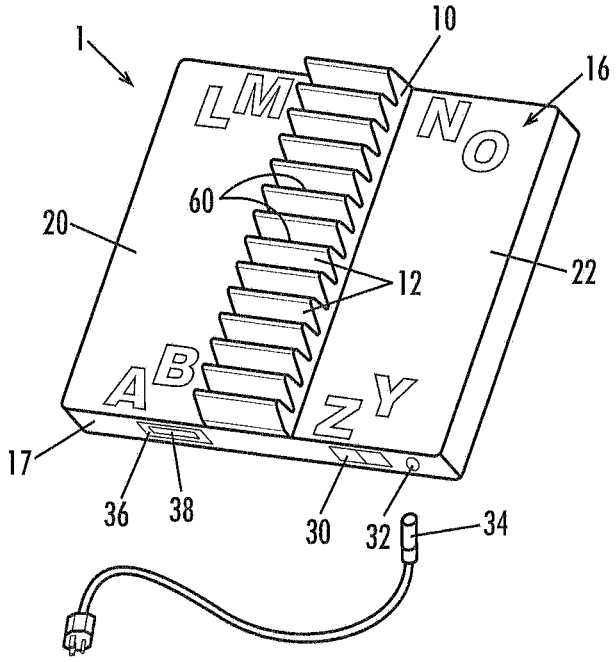
FIG. 1 is a perspective view of an interactive finger ladder, according to a first aspect provided herein.

According to a first aspect shown in FIG. 1, an interactive finger ladder 1 includes a housing 16 from which projects a vertically extending finger ladder 10 and a pair of display panels 20, 22 disposed radially on each side of the finger ladder 10. The finger ladder 10 may be flush with the surface of the display panels 20, 22, or may protrude slightly from the surface of the display panels 20, 22, as shown in FIG. 1.

The finger ladder 1 has a number of steps, or rungs, 12 that are equally spaced along its length. Representative numbers of rungs 12 range from ten to thirty, although other numbers may be used. The dimensions of the rungs 12 are sized to encourage the user to move to the next rung (that is, having a greater vertical distance than horizontal distance). For instance, the vertical distance between the rungs 12 may be in the range of 0.5 inches to 1.5 inches, while the depth of each rung 12 (the horizontal distance) may be in the range of 0.25 inches to 0.5 inches. The rungs 12 may have contact surfaces of different shapes, such as those shown in FIGS. 5A through 5C. The contact surfaces may be flat, as shown, or may have a rounded, or curved, profile.

Each rung 12 is provided with a contact sensor 60 on its contact surface. The contact sensor 60 may be a heat sensor, a laser sensor, a motion-detecting sensor (such as an infrared sensor), a pressure-sensitive sensor (such as a membrane with diodes), or any other sensor suitable for this purpose. The sensors 60 function in conjunction with the display panels 20, 22 to produce sounds and/or images only when the sensors 60 are activated sequentially.

It should be understood that the display panels 20, 22 may produce a sound and/or image with activation of each sensor in sequence, or may produce a sound and/or image with some random or prescribed frequency based on the activation of each sensor in sequence (for example, a sound and/or image being produced when the user reaches every second or third rung in sequence). When the sequence is interrupted—for example, if the user skips a rung 12—the display panels 20, 22 either may fail to produce a stimulus image or sound or may produce a negative sound or image, such as a buzzing sound or a red light. Alternately, or in addition, the display panels 20, 22 and/or finger ladder 10 may be configured to vibrate if the user skips a rung 12.

The display panels 20, 22 provide visual images and/or audio stimulus for a user of the finger ladder 1, such that as the user's fingers contact the rungs 12 in sequence, an image or sound is produced by the display panels 20, 22. As mentioned above, a stimulus may be produced each time a sensor is contacted, or may be generated after the sequential activation of two or more sensors, either randomly or at a predetermined interval. For example, the display panels 20, 22 shown in FIG. 1 illustrate representative letters of the English alphabet, which may be accompanied by the playing of the alphabet song, although other images and/or sounds may be used instead (as will be described further herein). Such stimulus promotes learning in a young child or a slightly older child with learning challenges, such as may be caused by autism, cerebral palsy, attention deficit disorder, or attention deficit hyperactivity disorder.

The housing 16 may be provided with an electrical port 32 for connection to an electrical power cord 34, as well as an on/off switch 30. The interactive finger ladder 1 may be further configured to automatically turn off after a certain predetermined period of inactivity.

The housing 16 may also be provided with a control system, in the form of an embedded control system or a memory card. To that end, a port 36 for receipt of a memory card 38 may be provided in the housing 16. The memory card 38 may be interchangeable with other memory cards to provide a different stimulus for the user. Alternately, or additionally, the memory function may be embedded within the housing 16, using programmable logic chips, logic boards, microprocessors, or other control circuits (not shown). It is contemplated that the software contained in the memory of the interactive finger ladder 1 and/or the data contained in the programmable logic control, for example, may be configured to adapt to the number of rungs 12 the user successfully contacts or the speed with which the user contacts the rungs 12 and modify the images and/or sounds produced by the display panels 20, 22.

Figure 2A:
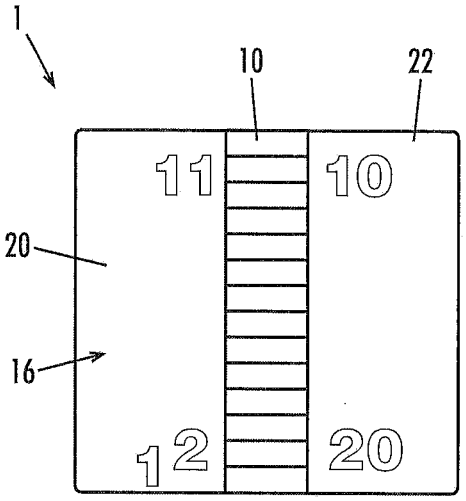
FIG. 2A is an overhead plan view of the front of the interactive finger ladder of FIG. 1.
Figure 2B:
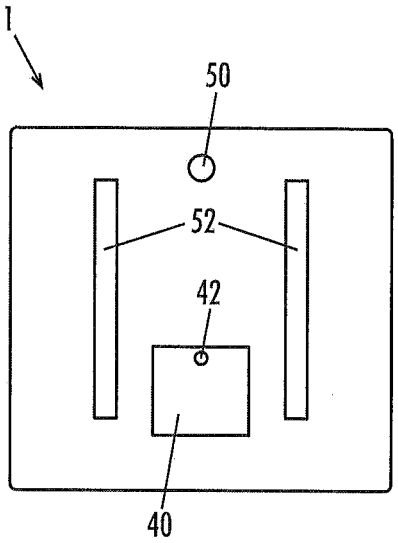
FIG. 2B is an overhead plan view of the back of the interactive finger ladder of FIG. 1.

FIGS. 2A and 2B show the interactive finger ladder 1 from the front and back, respectively. For illustrative purposes, the display panels 20, 22 of FIG. 2A feature numbers, which may be accompanied by a corresponding voice that counts the rungs as the user contacts them.

The back of the housing 16 may be provided with various means for hanging the interactive finger ladder 1 on a wall or other vertical surface. A recessed area 50 provides a means for hanging the finger ladder 1 on a nail. Alternately, the housing 16 may include hanging strips 52, which may be pressure-sensitive, releasable adhesive strips; magnets; or one half of a hook-and-loop fabric, the other portion being attached to a wall using its adhesive backing. In the case of a magnetic backing, the interactive finger ladder 1 may be attached to a refrigerator or home filing cabinet, allowing the child to play in proximity to a parent or other caregiver.

According to some aspects, the housing 16 further includes a battery panel 40 that is closed by a screw 42 for security. The interactive finger ladder 1 may be battery-operated or electrically powered using the power cord 24 shown in FIG. 1. The batteries may be conventional batteries or rechargeable batteries, as the user (or his parents) prefer. The interactive finger ladder 1 may further include a sleep mechanism as part of its control system, such that the device 1 is turned off after a prescribed period of inactivity.

Figure 3:
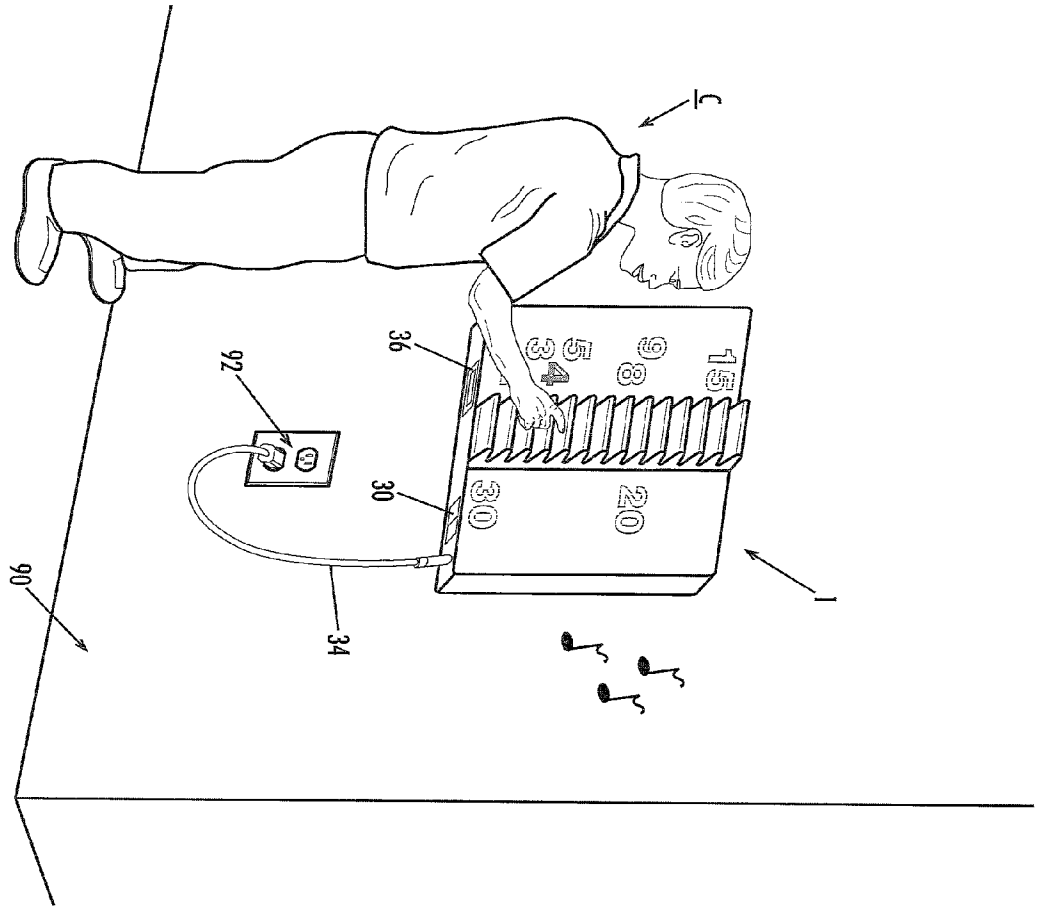
FIG. 3 is a perspective illustration of a child using the interactive finger ladder of FIG. 1.

FIG. 3 illustrates a child C engaging the interactive finger ladder 1. The interactive finger ladder 1 is hung on a wall 90 with the electrical cord 34 being plugged into an electrical outlet 92. The child C manipulates his fingers upward and downward in sequence, making contact with each rung 12, and the display panels 20, 22 display images and/or sounds to encourage his progress. The display panels 20, 22 may produce an image and/or sound with each activated sensor or with some frequency after the sequential activation of the sensors (e.g., production of a stimulus after every second or third sensor or production of a stimulus randomly as the sensors are activated).

Although letters and numbers have been shown in FIGS. 1, 2A, and 3, it should be understood that the display panels 20, 22 (e.g.) may be adapted to produce a wide range of images and/or sounds. For example, the images and/or sounds may produce an alphabetic sequence (that is, reciting the alphabet), a numerical sequence (such as counting to twenty), or a time sequence (such as reciting the days of the week). Alternately, the images and sounds may convey a story, a nursery rhyme, or a song. Yet another variation provides foreign language exercises (such as counting to twenty in Spanish or reciting the days of the week in French). The display panels 20, 22 may produce images of animals, cartoon characters, or other figures or scenes that are interesting to children or other users thereof.

Figure 4:
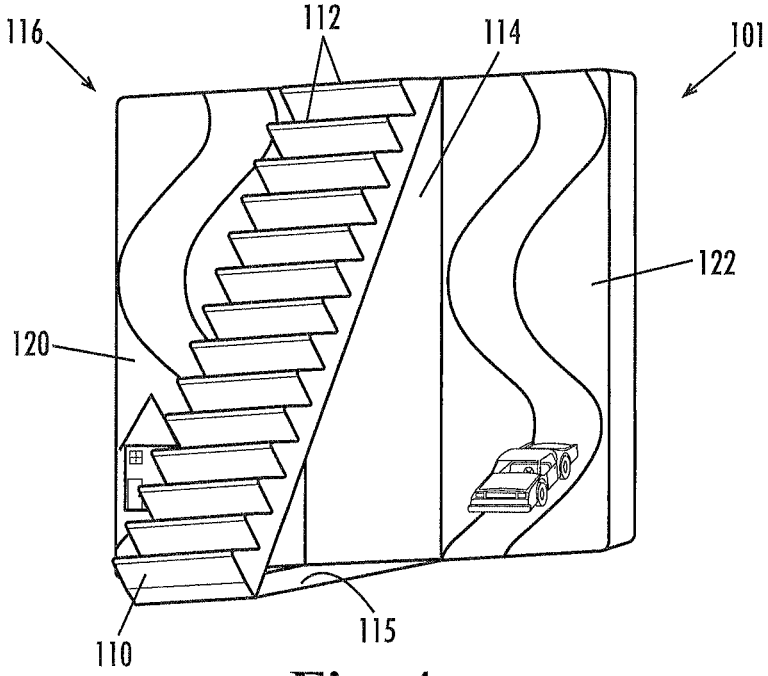
FIG. 4 is a perspective view of an interactive finger ladder, according to a second aspect provided herein.

An alternate interactive finger ladder 101 is shown in FIG. 4. In this variation, the finger ladder component 110 is configured to be extended from and retracted into the housing 116. The housing 116 is provided with a recessed portion 114 for holding the retracted finger ladder 110, the base of which is connected to a slidable panel 115 for extraction and retraction. In one construction, the slidable panel 115 is hinged at the edge adjacent the housing 116, in which case the edge adjacent the finger ladder 110 slides in an upward direction for retraction (behind the base of the finger ladder 110). Alternately, the slidable panel 115 may be hinged at the edge adjacent the finger ladder 110, in which case the edge adjacent the housing slides in an upward direction (within the recessed portion 114) for retraction. As before, the display panels 120, 122 produce images and/or sounds—such as, in this exemplary drawing, a car on a highway—as the user advances in sequential fashion up (or down) the rungs 112 of the ladder 110.

Regardless of its particular construction, the interactive finger ladder 1 (or 101 as in FIG. 4 or 201 as in FIG. 6) includes a plurality of rungs or steps 12 (112, 212, respectively), each outfitted with one or more sensors 60. The contact of the user's finger with each sensor 60 in sequential progression activates the display panels 120, 122, causing a sound or image to be produced, as discussed previously. In some instances, a sound and/or image is produced with each sensor 60 that is activated in sequence. In other instances, the display panels (e.g., 20, 22) are programmed to produce a sound and/or image after the sequential activation of multiple sensors, such that a stimulus is produced every second or third (or more) rung. In yet another variation, the display panels (e.g., 20, 22) may generate a stimulus randomly as the user contacts the sensors (e.g., 60) in sequence. Such a random pattern may motivate the user to continue his finger exercises, since he is uncertain of when a stimulus may be produced.

As shown herein, two display panels 20, 22 (or 120, 122) are illustrated, with a display panel being located on each side of the finger ladder 10 (110). In some variations (not shown), a single display panel may be located along one side of a finger ladder. The operation of the single display panel functions in the same manner described above for an interactive finger ladder having two display panels. Yet another alternate construction is provided in FIG. 6, in which the rungs and display panels are integrated.

Figure 5A:
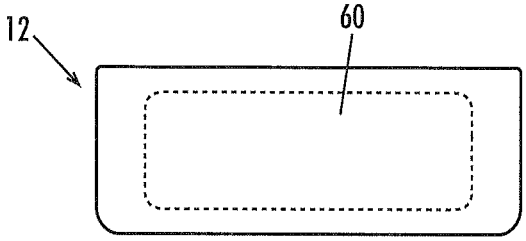
FIG. 5A is an overhead plan view of one of the rungs of the interactive finger ladder of FIG. 1, according to one aspect.

Turning now to a discussion of the rungs themselves, FIG. 5A illustrates a rung 12 with a generally rectangular surface area. The rung 12 may have rounded corners for safety. The sensor 60 covers a majority of the contact surface area of the rung 12, so that the user may contact the sensor 60 with either finger as he progresses up or down the ladder (10). The sensor 60 may be embedded within or attached to the contact surface of the rung 12. Although shown with a flat or planar surface, the rung 12 may instead have a rounded contact surface.

Figure 5B:
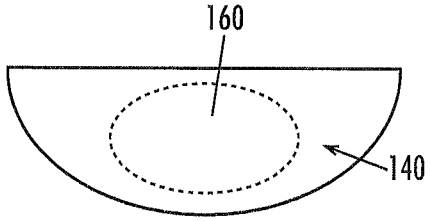
FIG. 5B is an overhead plan view of one of the rungs of the interactive finger ladder of FIG. 1, according to another aspect.

FIG. 5B illustrates an alternate rung shape 140, which resembles a generally semi-circular shape. Again, the sensor 160 covers a majority of the contact surface of the rung 140.

Figure 5C:
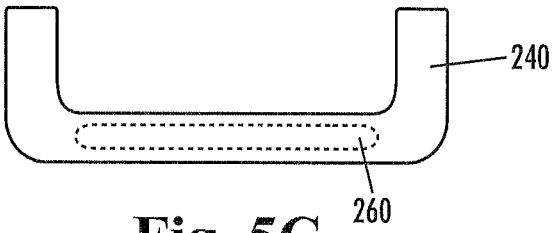
FIG. 5C is an overhead plan view of one of the rungs of the interactive finger ladder of FIG. 1, according to yet another aspect.

Another rung shape is illustrated in FIG. 5C, which shows a rung 240 having a generally U-shape, resembling a drawer pull. The center portion of the U-shaped rung 240 is provided with a sensor 260, which causes lights and/or sounds to be produced when contacted.

Figure 6:
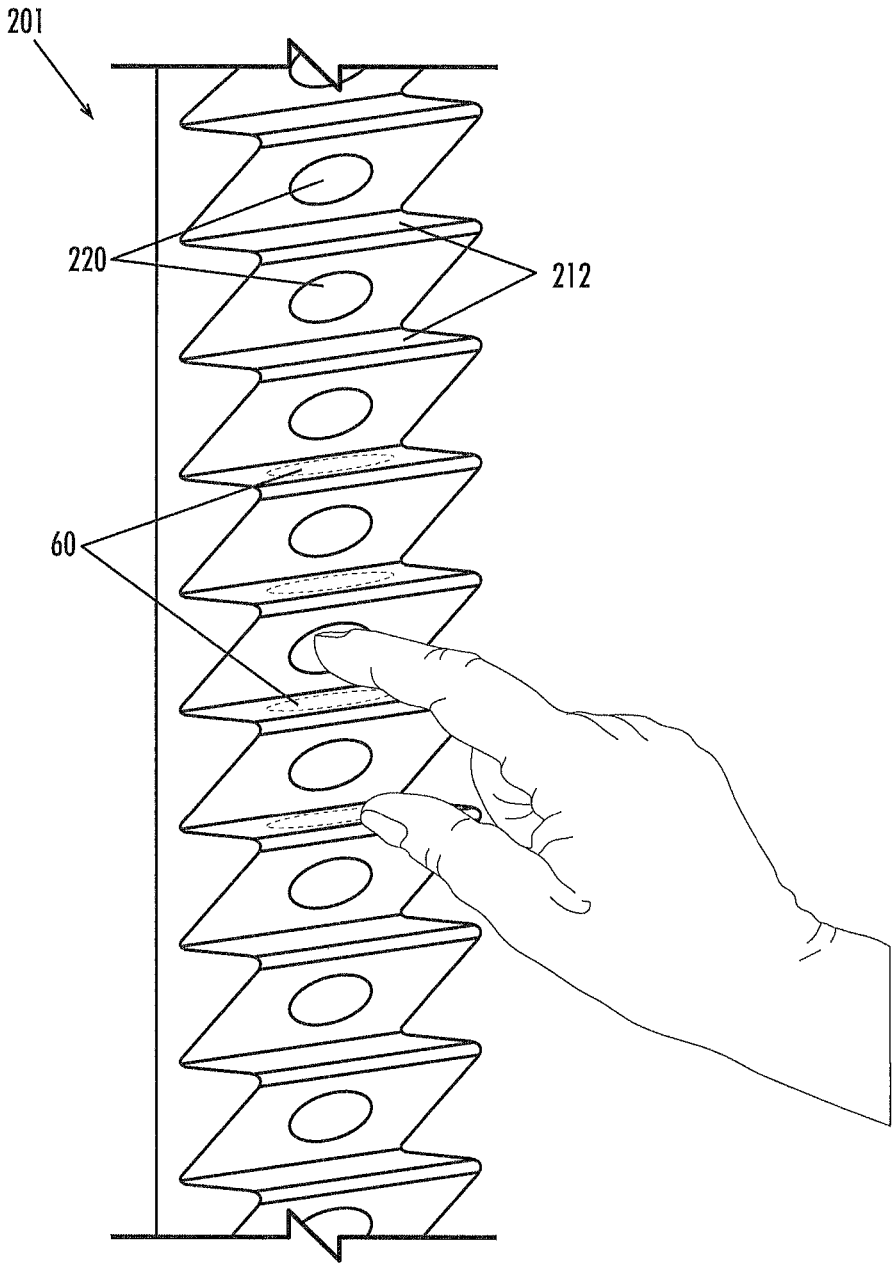
FIG. 6 is a perspective view of an alternate interactive finger ladder, according to a third aspect provided herein.

In another embodiment, shown in FIG. 6, an interactive finger ladder 201 is provided with display panels 220 that are integrated within the non-contact surfaces of the rungs 212. As the user advances his fingers up each rung and contacts a sensor 60, the display panels light up in response (either with each rung, after a pre-set number of rungs, or randomly). An audio stimulus may also be produced. The non-contact surfaces of the rungs 212 may be provided with display panels over a portion of their surfaces (as shown) or over a majority of their surfaces. The interactive finger ladder 201 may be mounted on a wall (e.g., using a nail or hook-and-loop fabric) or may be attached to a magnetic surface (e.g., a refrigerator or filing cabinet), as described previously.

In yet another embodiment (not shown), the rungs of the finger ladder may be provided with both sensors and display panels. In this construction, the display panels in each rung may light up when the corresponding sensor for a particular rung is activated. The lights in the display panels may be a single color or may be different colors (such as the colors of the rainbow). Sounds may also be produced with the activation of the sensors, if so desired. The sounds may correspond to the colors being displayed, the number of rungs that have been contacted, or any other sound or sequence from a simple tone or "ding" to the more complex sequences or stories discussed above.

While the interactive finger ladders described and shown herein include rungs with contact surfaces that are generally parallel to the floor, it is contemplated that this orientation is not required. That is, the rungs could be oriented such that their slope forms an acute angle relative to the floor (or other surface), if so desired.

Further, although the discussion herein may have implied that the sequential activation of the sensors should begin at the bottom of the ladder and work in an upward direction, it should be appreciated that the user may begin at any point along the finger ladder (that is, contacting any sensor at any location along the ladder) and may work in either an upward or downward direction.

The preceding discussion merely illustrates the principles of the present interactive finger ladder device. It will thus be appreciated that those skilled in the art may be able to devise various arrangements, which, although not explicitly described or shown herein, embody the principles of the inventions and are included within their spirit and scope. Furthermore, all examples and conditional language recited herein are principally and expressly intended to be for educational purposes and to aid the reader in understanding the principles of the inventions and the concepts contributed by the inventor to furthering the art and are to be construed as being without limitation to such specifically recited examples and conditions.

Moreover, all statements herein reciting principles, aspects, and embodiments of the invention, as well as specific examples thereof, are intended to encompass both structural and functional equivalents thereof. Additionally, it is intended that such equivalents include both currently known equivalents and equivalents developed in the future, i.e., any elements developed that perform the same function, regardless of structure. Terms such as "upper", "top", and "lower" are intended only to aid in the reader's understanding of the drawings and are not to be construed as limiting the invention being described to any particular orientation or configuration.

This description of the exemplary embodiments is intended to be read in connection with the figures of the accompanying drawings, which are to be considered part of the entire description of the invention. The foregoing description provides a teaching of the subject matter of the appended claims, including the best mode known at the time of filing, but is in no way intended to preclude foreseeable variations contemplated by those of skill in the art.

We claim:

1. An interactive device comprising:

a finger ladder having an elongate frame and a plurality of rungs positioned transversely across and extending radially outward from the elongate frame, each of the rungs having an edge distal from the elongate frame, the distance between the distal edge and the elongate frame defining a depth of each rung, such depth defining a planar step, wherein the distal edges of consecutive rungs are spaced at a uniform vertical distance greater than the depth of each rung, wherein the uniform distance being between about 0.5 inches and about 1.5 inches;

a plurality of sensors, at least one sensor being associated with each planar step; and a display system integrated with a portion of the elongate frame and operably connected to the sensors, such that sequential activation of the sensors results in at least one of an image and a sound being produced by the display system.

2. The interactive device of claim 1, wherein at least one of an image and a sound is produced each time one of the plurality of sensors is activated in sequence.

3. The interactive device of claim 1, wherein the display system comprises two display panels, the display panels being connected to each side of the elongate frame, such that the display panels and the elongate frame are substantially co-planar.

4. The interactive device of claim 3, wherein the display panels are integral with the finger ladder.

5. The interactive device of claim 4, wherein the device is comprised of a material selected from the group consisting of plastic, high-density foam, wood, aluminum, resin, and a textile material.

6. The interactive device of claim 1, wherein the sensors are at least one of heat sensors, laser sensors, infrared motion-detector sensors, and pressure-sensitive sensors.

7. The interactive device of claim 1, wherein the sequential activation of the sensors from rung to rung of the finger ladder results in a series of images or sounds being produced by the display panel.

8. The interactive device of claim 7, wherein the series of images represent at least one of a story, a nursery rhyme, an alphabetic sequence, and a numerical sequence.

9. The interactive device of claim 7, wherein the series of sounds produce at least one of a song, a story, a nursery rhyme, an alphabetic sequence, a numerical sequence, a foreign language sequence, and a time sequence.

10. The interactive device of claim 1, wherein the finger ladder comprises between ten and thirty rungs.

11. The interactive device of claim 1, further comprising a power source.

12. The interactive device of claim 11, wherein the power source is at least one of a battery, a rechargeable battery, and an alternating current power cord.

13. The interactive device of claim 11, further comprising an on/off switch.

14. The interactive device of claim 11, further comprising a sleep mechanism, the sleep mechanism turning the device off after a period of lack of use.

15. The interactive device of claim 1, further comprising a mounting mechanism selected from the group consisting of a hole defined through the device, magnets, slots, and hook-and-loop panels, the mounting mechanism being configured to secure the interactive device to a vertical surface.

16. The interactive device of claim 1, further comprising a first software storage element, the first software storage element providing control instructions for the display panels to produce at least one of images and sounds.

17. The interactive device of claim 16, wherein the software storage element is removable from the device.

18. The interactive device of claim 17, further comprising a second software storage element comprising control instructions for the display panels to produce at least one of images and sounds different from the images and sounds produced by the first software storage element.

* * * * *